US011353809B2

(12) United States Patent
Koyanagi

(10) Patent No.: US 11,353,809 B2
(45) Date of Patent: Jun. 7, 2022

(54) COOLING DEVICE, IMAGE FORMING APPARATUS AND IMAGE FORMING SYSTEM

(71) Applicant: Canon Kabushiki Kaisha, Tokyo (JP)

(72) Inventor: Noriaki Koyanagi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/112,183

(22) Filed: Dec. 4, 2020

(65) Prior Publication Data

US 2021/0103237 A1 Apr. 8, 2021

Related U.S. Application Data

(63) Continuation of application No. PCT/JP2019/023387, filed on Jun. 6, 2019.

(30) Foreign Application Priority Data

Jun. 8, 2018 (JP) ..... JP2018-110729
May 20, 2019 (JP) ..... JP2019-094689

(51) Int. Cl.
*G03G 15/20* (2006.01)

(52) U.S. Cl.
CPC ..... *G03G 15/2021* (2013.01); *G03G 15/2025* (2013.01); *G03G 15/2028* (2013.01); *G03G 2215/2032* (2013.01)

(58) Field of Classification Search
CPC ..... G03G 15/2021; G03G 15/32
See application file for complete search history.

(56) References Cited

U.S. PATENT DOCUMENTS

| | | | | |
|---|---|---|---|---|
| 7,865,122 | B2 * | 1/2011 | Koyama | G03G 15/6573 399/341 |
| 2013/0177332 | A1 * | 7/2013 | Saito | G03G 15/2021 399/92 |
| 2021/0072699 | A1 | 3/2021 | Inoue et al. | G03G 15/2017 |

FOREIGN PATENT DOCUMENTS

| | | | |
|---|---|---|---|
| JP | H05-158364 | A | 6/1993 |
| JP | H07-302012 | A | 11/1995 |
| JP | 2004-191678 | A | 7/2004 |
| JP | 2011081136 | A * | 4/2011 |
| JP | 5272424 | B2 | 8/2013 |
| JP | 2014-170020 | A | 9/2014 |
| JP | 2015-94847 | A | 5/2015 |

(Continued)

OTHER PUBLICATIONS

JP_2011081136_A_T MachineTranslation, Japan, Ito, 2011.*
Written Opinion and International Search Report, dated Jul. 30, 2019, in International Application No. PCT/JP2019/023387.

*Primary Examiner* — Victor Verbitsky
(74) *Attorney, Agent, or Firm* — Venable LLP

(57) ABSTRACT

A recording material cooling device 20 includes a rotating endless first belt 21 and an endless second belt 25 which forms a cooling nip T4 with the first belt 21 and which nips and feeds the recording material in the cooling nip T4 through rotation. A heat sink 30 for cooling the first belt 21 or the second belt 25 is provided. On the second belt 25 side, a belt cleaning device 90 is provided. The belt cleaning device 90 contacts the second belt 25 and removes a deposited matter such as toner and a wax deposited on the second belt 25. The belt cleaning device is capable of removing the deposited matter deposited on the belt nipping and feeding the recording material for cooling the recording material.

12 Claims, 8 Drawing Sheets

(56) References Cited

FOREIGN PATENT DOCUMENTS

| | | | |
|---|---|---|---|
| JP | 2016-157091 | A | 9/2016 |
| JP | 2017-167316 | A | 9/2017 |

* cited by examiner

COOLING DEVICE, IMAGE FORMING APPARATUS AND IMAGE FORMING SYSTEM

CROSS-REFERENCE TO RELATED APPLICATIONS

This application is a continuation of International Patent Application No. PCT/JP2019/023387, filed Jun. 6, 2019, which claims the benefit of Japanese Patent Application No. 2018-110729, filed Jun. 8, 2018, and Japanese Patent Application No. 2019-094689, filed May 20, 2019. The foregoing applications are incorporated herein by reference in their entireties.

TECHNICAL FIELD

The present invention relates to a cooling device for cooling a recording material passed through a fixing device for fixing a toner image through heating, an image forming apparatus including the recording material cooling device, and an image forming system.

BACKGROUND ART

In an image forming apparatus of an electrophotographic type, a toner image formed on a recording material such as paper is fixed on the recording material by being heated and pressed by a fixing device. Fixation of the toner image is carried out by nipping and feeding the recording material by a fixing roller heated by a heater or the like and a pressing roller press-contacted to the fixing roller. The recording material is heated when the toner image is fixed, and therefore, the recording material fed from the fixing device is liable to increase in temperature compared with before the fixation. Then, after the toner image is fixed, as many recording materials fed while being kept at a temperature higher than a predetermined temperature are stacked on a stacking portion, there is a liability that the recording materials stacked on the stacking portion stick to each other. For suppressing such recording material sticking during stacking, in order to lower the temperature of the recording material after the toner image fixation, a deposited matter cooling device for cooling the recording material fed from the fixing device after the toner image fixation is provided (Japanese Patent No. 5272424). The recording material cooling device described Japanese Patent No. 5272424 is a cooling device of a belt cooling type in which one of a pair of feeding belts nipping and feeding the recording material fed from the fixing device is cooled by a heat sink, and the temperature of the recording material is lowered through the cooled feeding belt.

SUMMARY OF THE INVENTION

Problem to be Solved by the Invention

In recent years, the image forming apparatus is required to have a multimedia compatibility so as to be capable of meeting recording materials of various kinds, such as plain paper, thick paper, roughed paper (surface roughed paper), uneven paper (embossed paper or the like), and coated paper. Further, in recent years, in order to fix the toner on the recording material even at a low temperature, toner containing a wax which starts to melt at the low temperature is used. In the case where image formation is carried out using such toner, the toner and the wax was transferred and deposited from the recording material onto a belt of a recording material cooling device in some instances. Particularly, during printing of the thick paper, the coated paper and the like which are poor in thermal conductivity compared with the plain paper, deposition of the toner and the wax onto the belt was conspicuous. The toner and the wax which were deposited on the belt can cause image non-uniformity and image contamination on the recording material which thereafter passes through the cooling device and can cause contamination of the recording material when paper powder, dust and the like are deposited on the deposited wax.

The present invention has been accomplished in view of the above-described problem, and aims to provide a cooling device, an image forming apparatus and an image forming system capable of removing a deposited matter deposited on the belt nipping and feeding the recording material for cooling the recording material in a constitution in which the recording material passed through the fixing device is cooled by the belt cooling type.

Means for Solving the Problem

The cooling device, the image forming apparatus and the image forming system according to the present invention include a first belt, a second belt for forming a nip between itself and the first belt in contact with the first belt and for nipping and feeding the recording material in cooperation with the first belt, a cooling unit for cooling the first belt or said second belt, and a cleaning unit for removing a deposited matter deposited on the second belt in contact with an outer peripheral surface of the second belt.

Effect of the Invention

According to the present invention, in the constitution in which the recording material after the toner image fixation is cooled by the belt cooling type, it is possible to remove the deposited matter deposited on the second belt which forms the nip between itself and the first belt and which nips and feeds the recording material.

EMBODIMENTS FOR CARRYING OUT THE INVENTION

First Embodiment

<Image Forming Apparatus>

Figure 1:
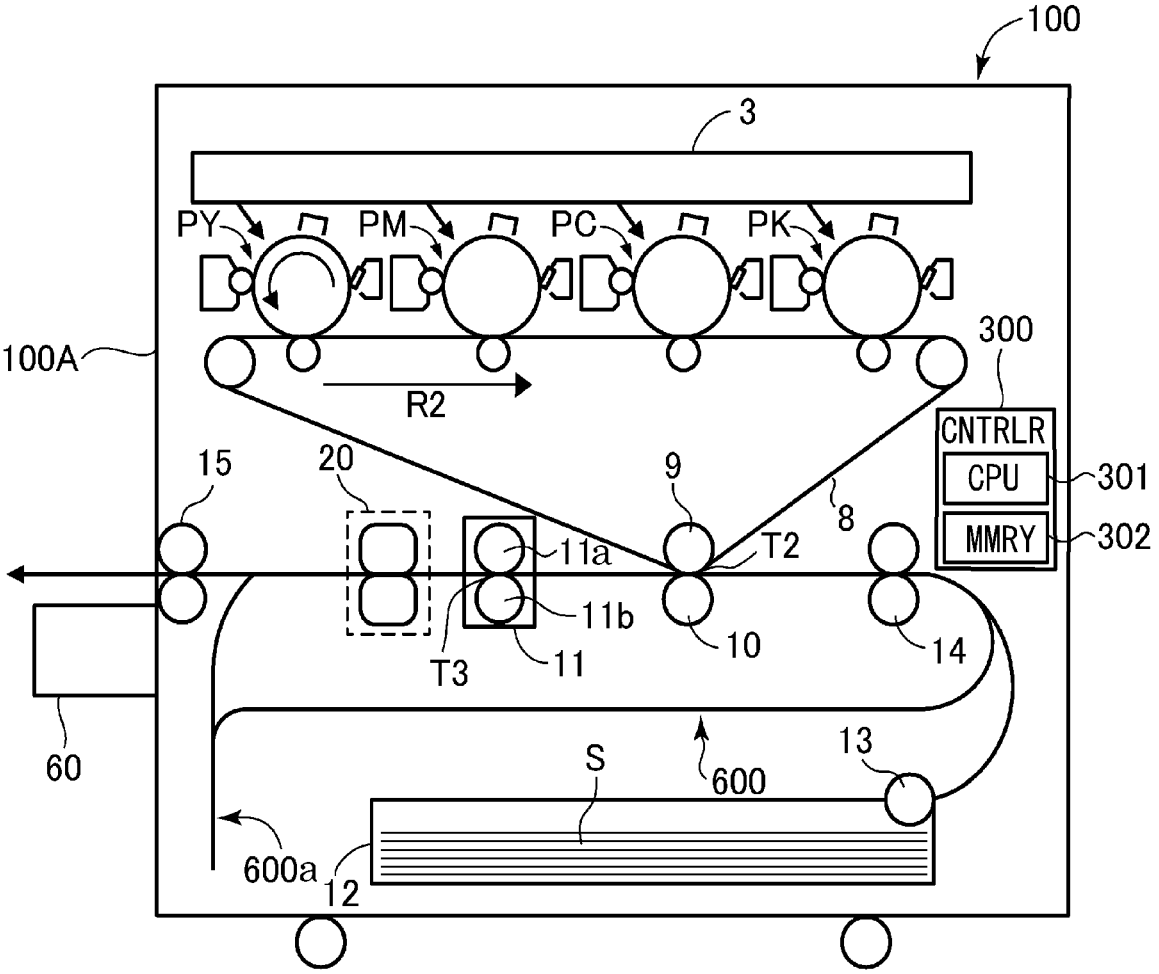
FIG. 1 is a schematic view showing a structure of an image forming system of this embodiment.

A schematic structure of an image forming apparatus of this embodiment will be described using FIGS. 1 and 2. An image forming apparatus 100 shown in FIG. 1 is an electrophotographic full-color printer of a tandem type. The image forming apparatus 100 includes image forming portions PY, PM, PC and PK for forming images of yellow, magenta, cyan and black, respectively. The image forming apparatus 100 forms a toner image on a recording material S in response to an image signal sent from an original reading device (not shown) connected to an apparatus main assembly 100A or from an external device such a personal computer communicatably connected to the apparatus main assembly 100A. As the recording material S, it is possible to cite sheet materials of various kinds, such as sheets including plain paper, thick paper, roughened paper, uneven paper and coated paper; plastic films; and cloths.

As shown in FIG. 1, the image forming portions PY, PM, PC and PK are juxtaposed along a movement direction of the intermediary transfer belt 8 in the apparatus main assembly 100A. The intermediary transfer belt 8 is constituted so as to be stretched by the plurality of the stretching rollers and to be traveled in an arrow R2 direction. Further, the intermediary transfer belt 8 carries and feeds a primary-transferred toner image. At a position opposing, through the intermediary transfer belt 8, a roller 9 stretching the intermediary transfer belt 8, an outer secondary transfer roller 10 is disposed, so that a secondary transfer portion T2 where the toner image on the intermediary transfer belt 8 is transferred onto the recording material S is formed. On a side downstream of the secondary transfer portion T2 with respect to a recording material feeding direction, a fixing device 11 is provided.

At a lower portion of the image forming apparatus 100, a cassette 12 in which recording materials S are accommodated. The recording material S is fed from the cassette 12 toward a registration roller pair 14 by a feeding roller 13 along a feeding passage 600 forming a path of the recording material S in the apparatus main assembly 100A. Thereafter, the registration roller pair 14 is started to be rotated in synchronism with the toner image formed on the intermediary transfer belt 8, so that the recording material S is fed toward the secondary transfer portion T2 along the feeding passage 600. Incidentally, in this embodiment, only one cassette 12 is shown, but a plurality of cassettes 12 capable of accommodating the recording materials different in size and thickness may also be provided, and in that case, the recording material S is selectively fed from either one of the plurality of cassettes 12 to the feeding passage 600. Further, the recording material S is not limited to the recording material S accommodated in the cassette 12, but the recording material S stacked on a manual feeding portion (not shown) may also be fed to the feeding passage 600. In the case of this embodiment, during double-side printing, the feeding passage 600 includes a reverse feeding portion 600*a* which reverses a front side and a back side of the recording material S cooled by a recording material cooling device 20 and which feeds again the recording material S to the image forming portions PY, PM, PC and PK.

<Image Forming Portion>

The four image forming portions PY, PM, PC and PK included in the image forming apparatus 100 have the substantially same constitution except that development colors are different from each other. Accordingly, in this embodiment, as a representative, the image forming portion PK will be described, and other image forming portions PY, PM and PC will be omitted from description.

Figure 2:
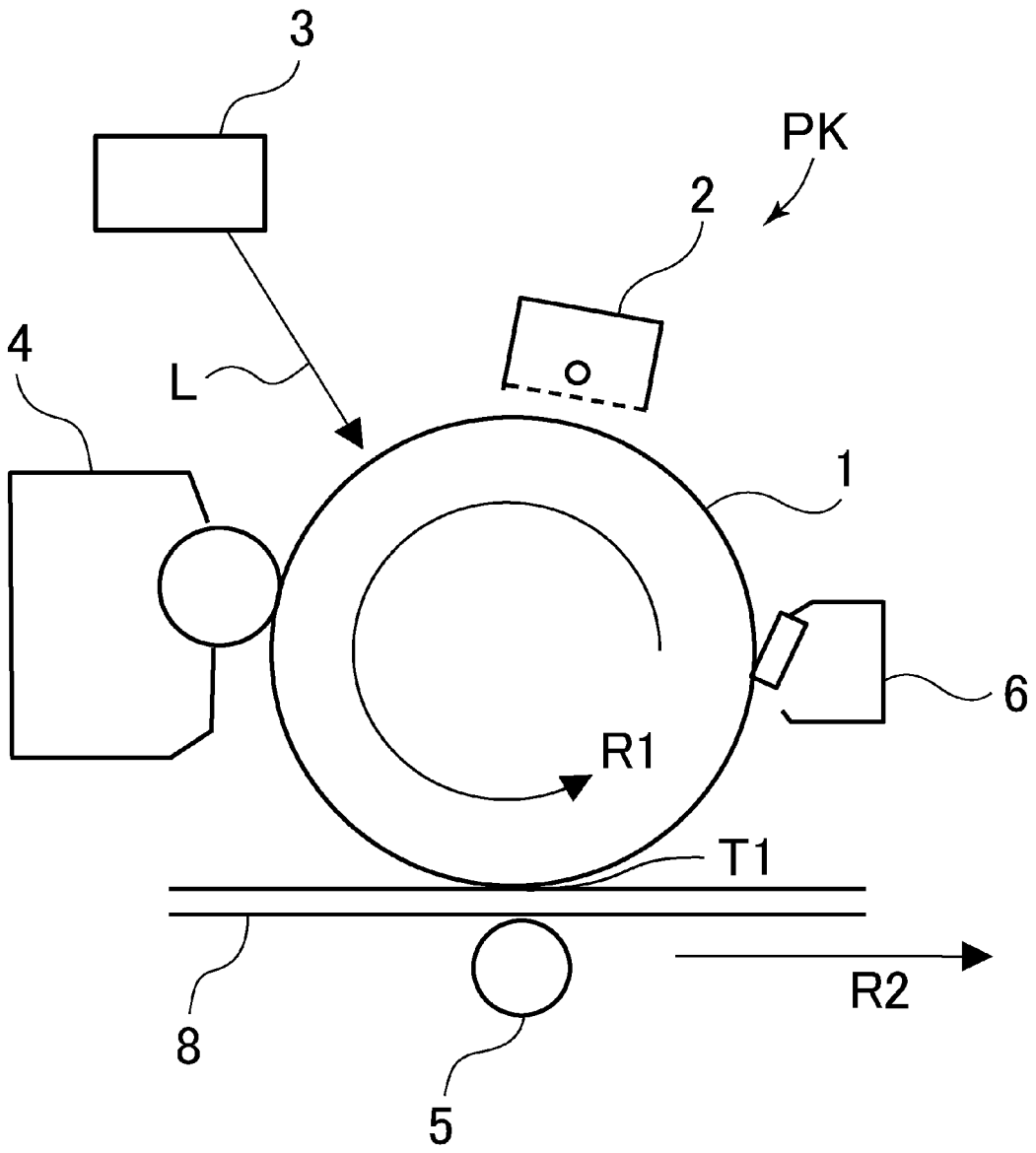
FIG. 2 is a schematic view showing an image forming portion.

As shown in FIG. 2, in the image forming portion PK, a cylindrical photosensitive drum 1 is provided as a photosensitive member. The photosensitive drum 1 is rotationally driven in an arrow R1 direction. At a periphery of the photosensitive drum 1, a charging device 2, an exposure device 3, a developing device 4, the primary transfer roller 5 and a drum cleaning device 6 are provided.

A process for forming, for example, a full-color image by the image forming apparatus 100 will be described. First, when an image forming operation is started, a surface of the rotating photosensitive drum 1 is electrically charged uniformly by the charging device 2. The charging device 2 is a corona charger or the like for charging the photosensitive drum 1 to a uniform negative dark-portion potential by irradiating the photosensitive drum 1 with charge particles with corona discharge, for example. Then, the photosensitive drum 1 is subjected to scanning exposure to laser light L which is emitted from the exposure device 3 and which corresponds to an image signal. By this, an electrostatic latent image depending on the image signal is formed on the surface of the photosensitive drum 1. The electrostatic latent image formed on the photosensitive drum 1 is visualized (developed) into a visible image by toner (developer) accommodated in the developing device 4.

The resultant toner image formed on the photosensitive drum 1 is primary-transferred onto the intermediary transfer belt 8 at a primary transfer portion T1 formed between the intermediary transfer belt 8 and the photosensitive drum 1 opposing the primary transfer roller 5. At this time, to the primary transfer roller 5, a primary transfer bias is applied. After the primary transfer, toner remaining on the surface of the photosensitive drum 1 is removed by the drum cleaning device 6.

Such an operation is sequentially performed in the image forming portions PY, PM, PC and PK for yellow, magenta, cyan and black, respectively, so that four color toner images are superposed on the intermediary transfer belt 8. Thereafter, in synchronism with toner image forming timings, the recording material S accommodated in the cassette 12 is fed to the secondary transfer portion T2. Then, by applying a secondary transfer bias (voltage) to the outer secondary transfer roller 10, the toner images for a full-color image are collectively secondary-transferred onto the recording material S.

Then, the recording material is fed to the fixing device 11. The fixing device 11 includes a fixing roller 11*a* provided rotatably and a pressing roller 11*b* rotating while being press-contacted to the fixing roller 11*a*. In a state in which the pressing roller 11*b* is press-contacted to the fixing roller 11*a*, the fixing roller 11*a* is rotated at a predetermined rotational speed (for example, 400 mm/sec) by an unshown motor. Inside the fixing roller 11*a*, a halogen heater 11*c* (not shown) is provided, and by the halogen heater 11*c*, a surface temperature of the fixing roller 11*a* is increased, so that the fixing device 11 is capable of heating the recording material S.

At a fixing nip T3 formed by the fixing roller 11*a* and the pressing roller 11*b*, the fixing device 11 nips and feeds the recording material S on which the full-color toner image is formed and thus heats and presses fed recording material S, so that the full-color toner image is fixed on the recording material S. That is, the toners of the full-color toner image formed on the recording material S are melted and mixed by heating and pressing, and are fixed as a full-color image on the recording material S. Thus, a series of operations of the image forming process is ended. Then, the recording material S passed through the fixing device 11 is fed from the fixing device 11 toward the recording material cooling device 20. The recording material cooling device 20 as a cooling device cools the recording material S. The recording material cooling device 20 will be described later (see FIG. 3).

<Controller>

As shown in FIG. 1, the image forming apparatus 100 includes a controller 300. The controller 300 carries out various pieces of control, such as an image forming operation, of the image forming apparatus 100, and includes a CPU 301 (Central Processing Unit) and a memory 302 such as a ROM, a RAM or a hard disk device. In the memory 302, for example, various programs such as an image forming job for forming the image on the recording material S, and various data and the like are stored. The controller 300 is capable of executing the various programs stored in the memory 302 and is capable of causing the image forming apparatus 100 to operate by executing the various programs. Incidentally, the memory 302 can also temporarily store a calculation (computation) process result with execution of the various programs.

The controller 300 is capable of executing, as the image forming job, a one-side printing job in which the toner image is fixed only on one side (surface) of the recording material S and a double-side printing job in which the toner images are fixed on both (double) sides (surfaces) of the recording material S. In the case of the one-side printing job, the recording material S cooled by the recording material cooling device 20 is discharged to an outside of the apparatus main assembly 100A (outside the apparatus main assembly), and is stacked on a stacking unit 60. On the other hand, in the case of the double-side printing job, the recording material S cooled by the recording material cooling device 20 is reversed by the reverse feeding portion 600*a*, whereby a front side and a back side of the recording material S are changed to each other. The reversed recording material S is returned to the feeding passage 600 and is fed toward the registration roller 14 along the feeding passage 600, and is fed to the secondary transfer portion T2 by the registration roller 14 in a state in which a side where the toner image is not printed faces toward the intermediary transfer belt 8 side. At the secondary transfer portion T2, the full-color toner image formed on the intermediary transfer belt 8 is collectively secondary-transferred onto the recording material S (the back-surface side). Thereafter, the recording material S is subjected to toner image fixation by the fixing device 11 and cooling by the recording material cooling device 20, and the recording material S after the cooling is discharged to the outside of the apparatus main assembly 100A and is stacked on the stacking unit 60.

<Recording Material Cooling Device>

Figure 3:
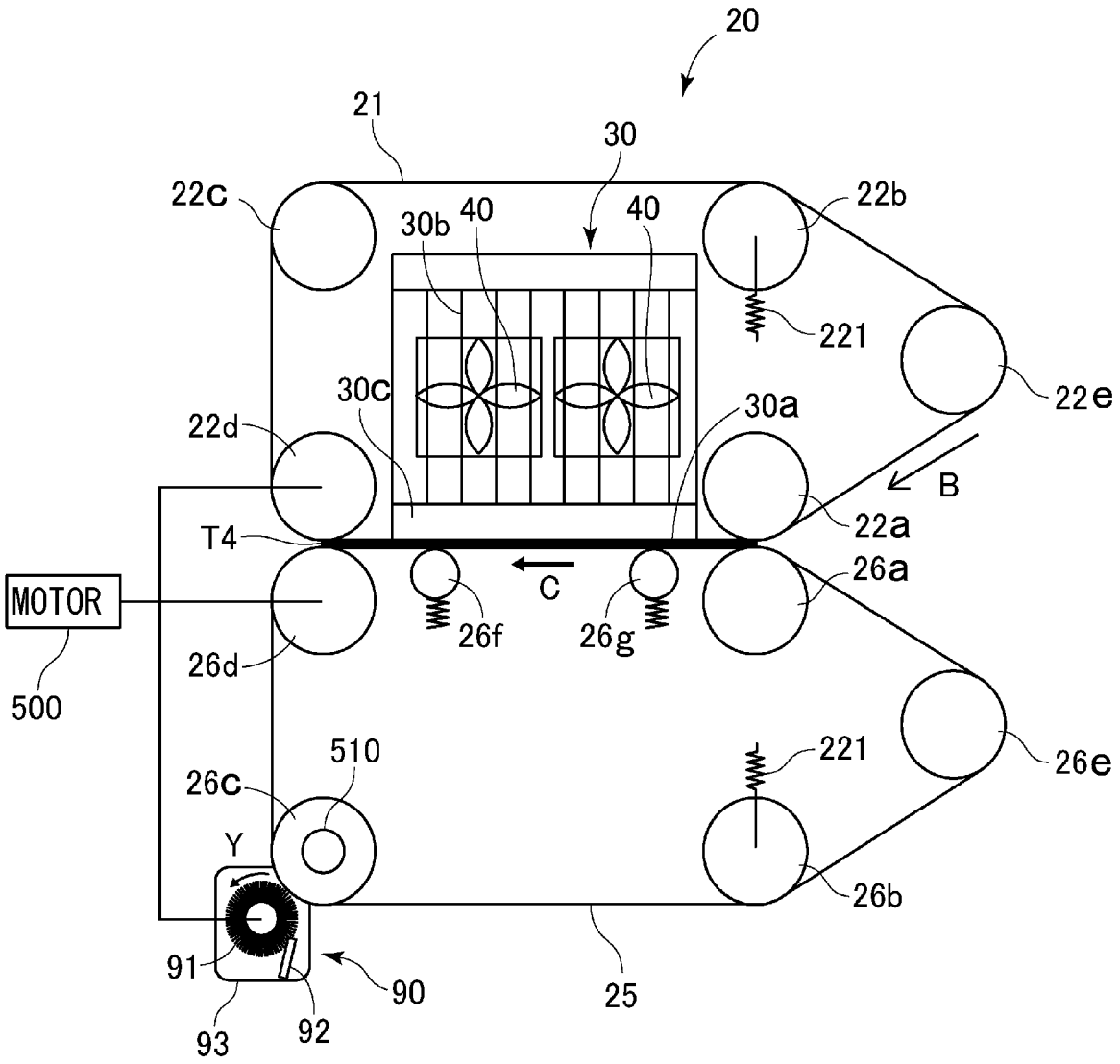
FIG. 3 is a schematic view showing a recording material cooling device of a first embodiment.

Next, the recording material cooling device 20 of the first embodiment will be described using FIG. 3. The recording material cooling device 20 of this embodiment is the cooling device of the belt cooling type. As shown in FIG. 3, the recording material cooling device 20 includes an endless first belt 21 and an endless second belt 25 feeding the recording material S while nipping the recording material S with the first belt 21. For example, the first belt 21 and the second belt 25 are formed (made) of polyimide high in strength and are set so as to have a thickness of 100 μm and a peripheral length of 942 mm. Further, the recording material cooling device 20 includes a heat sink 30 for cooling the first belt 21. In the cases of this embodiment, the heat sink 30 contacts the first belt 21 contacting the recording material S on a side where the toner image is formed (fixed) by the fixing device 11. Incidentally, this is not limited to cooling of the first belt 21 by the heat sink 30. For example, a belt fan or the like capable of cooling the first 21 belt by blowing the air toward the first belt 21 may also be used.

The first belt 21 is extended around a plurality of first belt stretching rollers 22*a* to 22*e*, and at least any one of the first belt stretching rollers 22*a* and 22*e* is rotated by the driving motor 500. In the case of this embodiment, the first belt stretching roller 22*d* rotated by the driving motor 500 corresponds to a driving roller for driving the first belt 21. By this, the first belt 21 is rotated in an arrow B direction in the figure. On the other hand, the second belt 25 is extended around a plurality of second belt stretching rollers 26*a* to 26*e*, and contacts the first belt 21. Further, at least any one of the second belt stretching rollers 26*a* and 26*e* is rotated by the driving motor 500. In the case of this embodiment, the second belt stretching roller 26*d* rotated by the driving motor 500 corresponds to a driving roller for driving the second belt 25. Thus, the first belt 21 and the second belt 25 are rotated in the same direction in a cooling nip T4 by the driving motor 500 which is the same driving source, through a driving gear (not shown) or the like.

Incidentally, in this embodiment, both the first belt 21 an the second belt 25 are driven by the driving motor 500, but the present invention is not limited thereto. For example, only the first belt 21 driven by the driving motor 500 and the second belt 25 may also be driven by the first belt 21, or the second belt 25 is driven by the driving motor 500 and the first belt 21 may also be driven by the second belt 25.

Further, either one of the first belt stretching rollers 22*a* to 22*e* and either one of the second belt stretching rollers 26*a* to 26*e* are steering rollers provided for controlling shifts of the first belt 21 and the second belt 25, respectively. In the case of this embodiment, for example, the first belt stretching roller 22*b* and the second belt stretching roller 26*b* are the steering rollers. These steering rollers (22*b*, 26*b*) are urged by springs 221 so that the first belt 21 and the second belt 25 are urged from inner periphery sides toward outsides so as to provide the first belt 21 and the second belt 25 with tension of about 39.2 N (about 4 kgf). The steering rollers (22*b*, 26*b*) controls meandering of the first belt 21 and the second belt 25 by forming a rudder angle with a central portion, as a rotation supporting point, with respect to a rotational axis direction (longitudinal direction) thereof.

Further, on the inner periphery side of the second belt 25, pressing rollers 26*f* and 26*g* for pressing the second belt 25 toward the heat sink 30. The pressing rollers 26*f* and 26*g* press the second belt 25 at a pressing force of, for example, 9.8 N (1 kgf), so that the first belt 21 is reliably contacted to the heat sink 30 (specifically, a heat-receiving portion 30*a* described later) through the second belt 25.

The recording material S passed through the fixing device 11 is nipped between the first belt 21 and the second belt 25, and is fed in a feeding direction (arrow C direction in the figure) in accordance with rotation of these belts. At that time, the recording material S passes through the cooling nip T4 formed by contact between the first belt 21 and the second belt 25. In the case of this embodiment, the first belt 21 is cooled by the heat sink 30. In order to efficiently cool the recording material S, the heat sink 30 is disposed so as to contact an inner surface of the first belt 21 at a position where the cooling nip T4 is formed. The recording material S is cooled through the first belt 21 when the recording material S passes through the cooling nip T4. For example, in the case where a temperature of the recording material S is about 90° C. before the recording material S passes through the recording material cooling device 20, the recording material S is cooled so as to become about 60° C. after the recording material S passed through the recording material cooling device 20. With this cooling of the recording material S, the toner on the recording material S is cooled and fixed.

The heat sink 30 as a cooling unit is a heat dissipation plate formed of metal such as aluminum, for example. The heat sink 30 includes the heat-receiving portion 30*a* for taking heat from the first belt 21 in contact with the first belt 21, a heat-dissipating portion 30*b* for dissipating the heat, and a fin base 30*c* for conducting the heat from the heat-receiving portion 30*a* to the heat-dissipating portion 30*b*. The heat-dissipating portion 30*b* is formed with many dissipating fins in order to prompting efficient heat dissipation by increasing a contact area with the air. For example, the dissipating fins are set so that a thickness is 1 mm, a height is 100 mm and a pitch is 5 mm. Further, in order to forcedly cool the heat sink 30 itself, a cooling fan 40 for blowing the air toward the heat sink 30 (specifically, the heat-dissipating portion 30*b*) is provided. An air flow rate of this cooling fan 40 is set at, for example, 2 $m^3$/min. Incidentally, the cooling of the heat sink 30 is not limited to the cooling fan 40. Further, the heat sink 30 may also be cooled by blowing the air to the heat sink 30 from an outside of the apparatus main assembly 100A to an inside of the apparatus main assembly 100A through a duct, or a pipe through which a cooling medium is circulated is provided in the heat sink 30 and the heat sink 30 may also be cooled by the cooling medium.

Incidentally, during the double-side printing, as described above, the recording material on which the toner image is fixed on a first surface by the fixing device 11 passes through the fixing device 11 again in a state in which the toner image is formed on a second surface on a side opposite from the first surface. That is, the recording material S passes through the fixing device 11 two times.

In this case, when the recording material S passes through the fixing device 11 at the second time, the toner image fixed early on the recording material S is melted again together with the toner image formed later on the recording material S. By this, the recording material S in the case of the double-side printing is fed to the recording material cooling device 20 in a state in which both the toner images on the first surface and the second surface are soft. Thereafter, the toner softened by passing through the fixing device 11 is solidified by being cooled to lower in temperature, and is fixed on the recording material S by being separated from the first belt 21 and the second belt 25.

Here, the second belt 25 of the recording material cooling device 20 is cooled by the heat sink 30 through the first belt 21, whereby accumulated heat in the belt is not readily taken than the first belt 21 directly cooled by the heat sink 30.

For that reason, as regards the recording material S during the double-side printing, when the recording material S is fed to the cooling nip T4 of the recording material cooling device 20, the surface contacting the second belt 25 is not readily cooled (heat is not readily taken) than the surface contacting the first belt 21 is. By this, the toner image on the surface contacting the second belt 25 is not readily solidified compared with the toner image on the surface contacting the first belt 21, so that on the second belt 25, the toner on the recording material S and a wax or the like separated from the toner are liable to be deposited as a deposited matter than on the first belt 21. Thus, the deposited matter deposited on the second belt 25 is needed to be removed since there is a liability that the deposited matter causes image non-uniformity and image contamination on the recording material S subsequently passing through the cooling nip T4 and that the recording material is contaminated with the deposited matter.

<Belt Cleaning Device>

Therefore, on the recording material cooling device 20 of this embodiment, in order to remove the deposited matter, such as the toner and the wax, deposited on the second belt 25, a belt cleaning device 90 as a cleaning unit is provided.

As shown in FIG. 3, the belt cleaning device 90 is a cleaning device of a brush type including a far brush roller 91, a scraper 92 and a housing 93. The far brush roller 91 and the scraper 92 are provided in the housing 93. The far brush roller 91 as a slidable member (rotatable slidable member) is prepared by planting nylon fibers onto an outer peripheral surface of an electroconductive roller in a brush shape, and this far brush contacts the outer peripheral surface of the second belt 25 while maintaining a predetermined penetration amount relative to the outer peripheral surface of the second belt 25.

The far brush roller 91 slides on the second belt 25 by being rotated in a direction (arrow Y direction in the figure) opposite to a rotational direction of the second belt 25 in a contact surface with the second belt 25. That is, at least either one of the far brush roller 91, the first belt 21 and the second belt 25 is driven by the driving motor 500 which is the same driving source. The far brush roller 91 slides on the second belt 25, so that the far brush roller 91 collects the deposited matter, deposited on the second belt 25, to the far brush roller 91 side. By this, the deposited matter is removed from the second belt 25. Then, the deposited matter collected by the far brush roller 91 is scraped off into the housing 93 by the scraper 92 contacting the far brush roller 91 with respect to a counterdirection opposite to a rotational direction thereof. The scraper 92 is a rubber blade formed with a rubber member such as an urethane rubber, for example. The housing 93 also function as an accommodating container accommodating the deposited matter scraped off.

The above-described belt cleaning device 90 may also be provided so as to slide on the second belt 25 at any position, but may preferably be provided so as to slide on the second belt 25 at a position from a downstream end of the cooling nip T4 to half of a peripheral length of the second belt 25 with respect to the rotational direction of the second belt 25. This is because when the deposited matter deposited on the second belt 25 passes through the position from the downstream end of the cooling nip T4 to the half of the peripheral length of the second belt, the deposited matter is liable to stick to the second belt 25 by being cooled so that it becomes difficult to remove the deposited matter. Further, the belt cleaning device 90 may preferably be provided so as to slide on the second belt 25 at a position where the belt cleaning device 90 sandwiches the second belt 25 between itself and a predetermined roller of the second belt stretching rollers 26*a* to 26*e*. This is because the second belt 25 is pressed against the predetermined roller by the belt cleaning device 90 and thus the belt cleaning device 90 can stably slide on the second belt 25. In view of the above points, in the case of this embodiment, as shown in FIG. 3, the belt cleaning device 90 is disposed opposed to the second belt stretching roller 26*c* (corresponding to the predetermined roller) while sandwiching the second belt 25 therebetween.

Incidentally, even when the steering roller (26*b*) is disposed at the position from the downstream end of the cooling nip T4 to the half of the peripheral length of the second belt 25, the belt cleaning device 90 is not disposed opposed to the steering roller (26*b*). This is because when the belt cleaning device 90 is disposed opposed to the steering roller (26*b*), there is a liability that shift control of the second belt 25 is not carried out with accuracy by the steering roller (26*b*).

Further, as shown in FIG. 3, the second belt stretching roller 26*c* to which the belt cleaning device 90 is disposed opposed may also be provided with a heater 510 on an inside thereof. The heater 510 as a heating unit heats the second belt stretching roller 26*c*. When the second belt stretching roller 26*c* is heated, the second belt 25 partially increases in temperature in the neighborhood of a sliding position warmed by the second belt stretching roller 26*c*. Then, a temperature of the deposited matter such as the toner and the wax, deposited on the second belt 25 can be made high before the deposited matter is removed by the belt cleaning device 90, so that removal of the deposited matter by the belt cleaning device 90 becomes easy. That is, the second belt stretching roller 26*c* is heated, whereby deposited matter removing power of the belt cleaning device 90 is improved.

Figure 4:
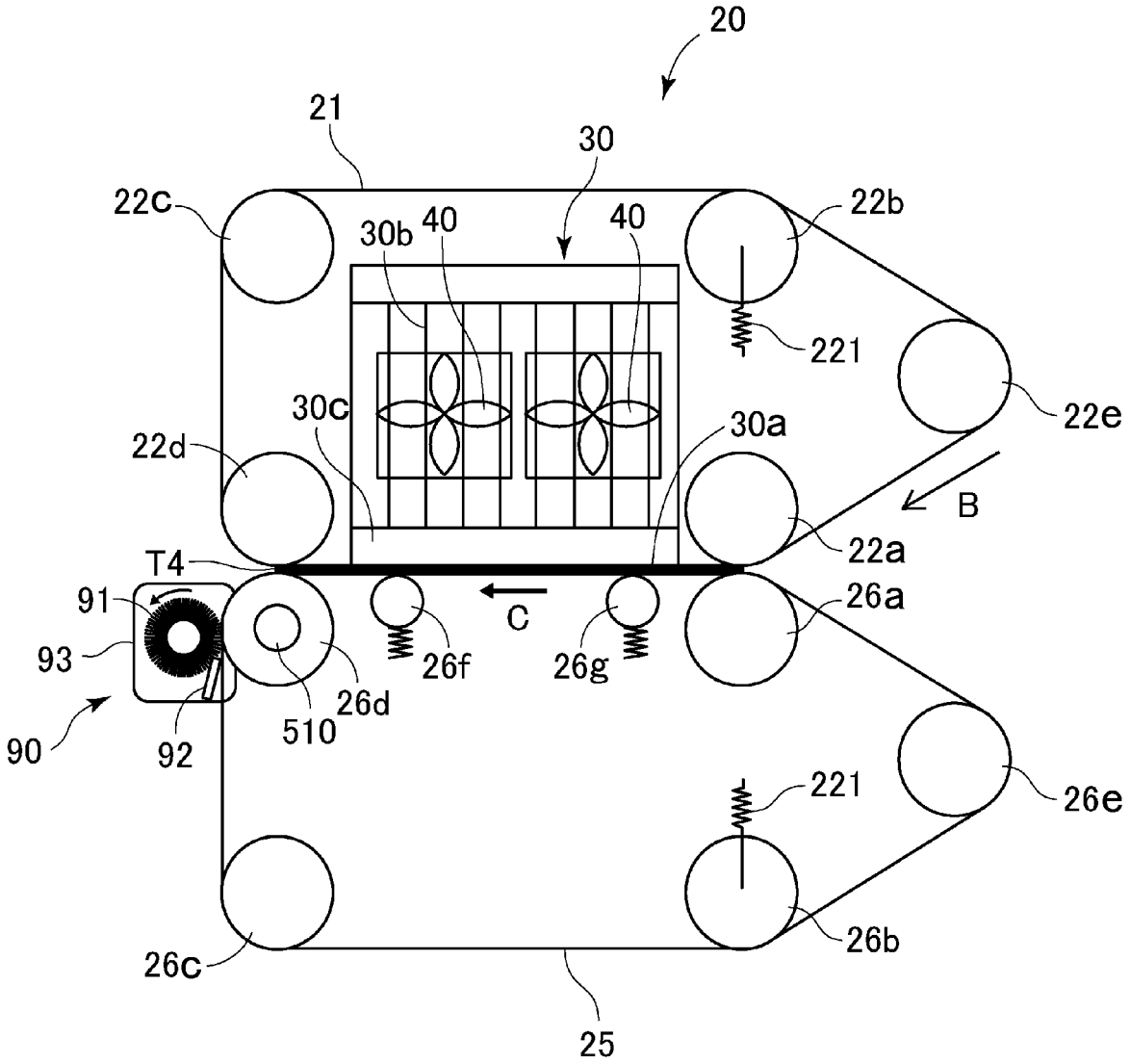
FIG. 4 is a schematic view for illustrating an arrangement of a belt cleaning device.

Or, as shown in FIG. 4, the belt cleaning device 90 may also be disposed opposed to the second belt stretching roller 26*d* functioning as the driving roller while sandwiching the second belt 25 therebetween. This case is immediately after the second belt 25 passed through the cooling nip T4 and before the temperature of the deposited matter, such as the toner and the wax, deposited on the second belt 25 starts to lower. Accordingly, the removal of the deposited matter by the belt cleaning device 90 is easy. Further, when a heater 510 is provided in the second belt stretching roller 26*d* and the temperature of the deposited matter on the second belt 25 can be made higher before the removal of the deposited matter by the belt cleaning device 90, the deposited matter on the second belt 25 can be removed further reliably and thus the provision of the heater 510 is preferred.

As described above, according to this embodiment, the belt cleaning device 90 is provided on the second belt 25 side where the second belt 25 is not directly cooled by the heat sink 30, and the belt cleaning device 90 is caused to slide on the second belt 25. By doing so, on the second belt 25 on which the deposited matter such as the toner and the wax is liable to be deposited from the recording material S by without direct cooling of the second belt 25 by the heat sink 30, the deposited matter deposited on the second belt 25 can be removed by the belt cleaning device 90.

Figure 5:
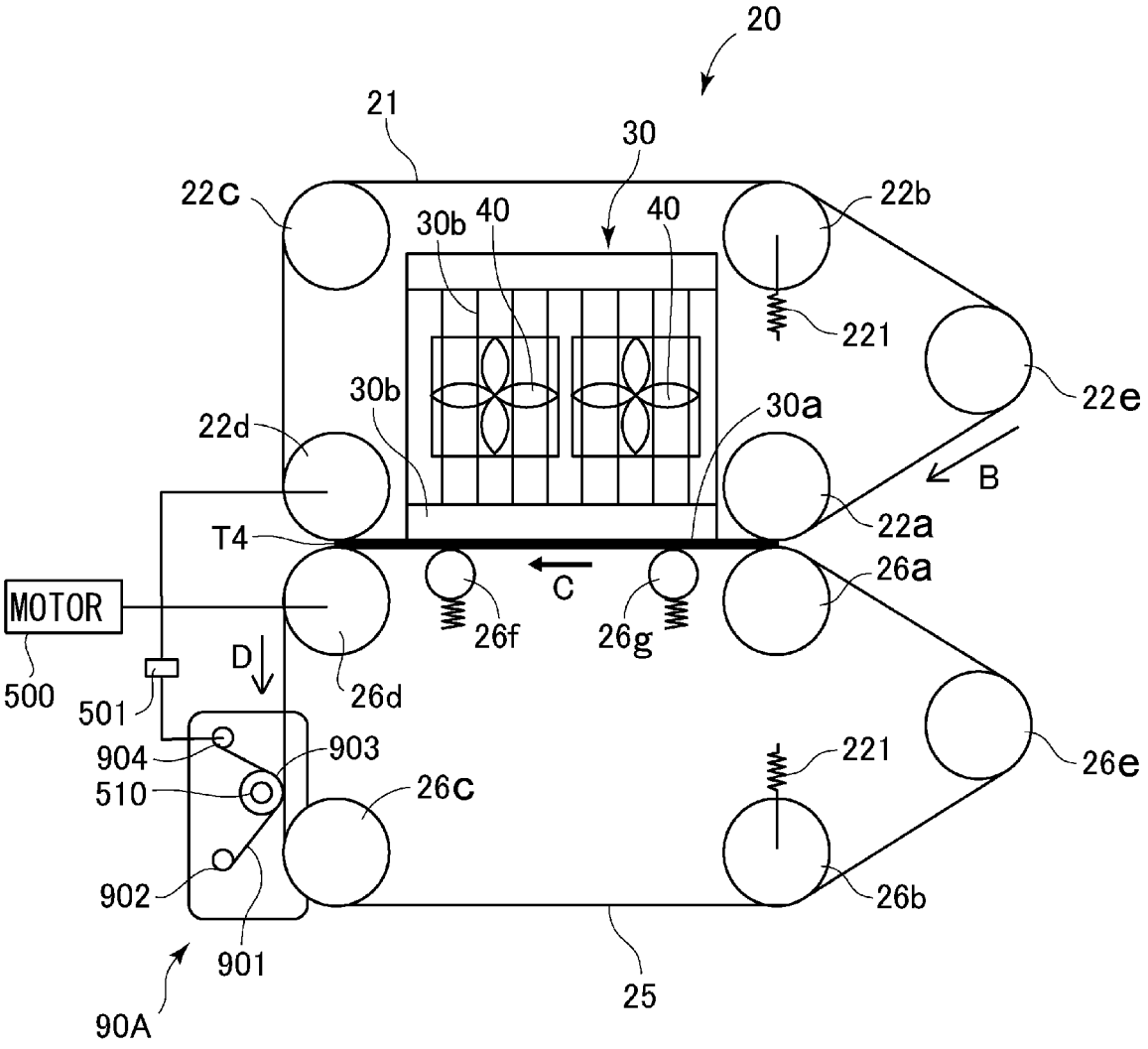
FIG. 5 is a schematic view showing a recording material cooling device using another belt cleaning device.

Incidentally, the belt cleaning device 90 may also be, in addition to the above-described members, for example, a cleaning blade made of an urethane rubber for mechanically scraping off and removing the deposited matter in contact with the second belt 25 with respect to the counterdirection opposite to the rotational direction of the second belt 25. Further, the belt cleaning device 90 may also be a belt cleaning device of a so-called web type in which a web which is a cloth-like member is caused to slide on the second belt 25 and the deposited matter is removed. A recording material cooling device 20 in the case where the belt cleaning device of the web type is used is shown in FIG. 5.

A belt cleaning device 90A includes a cloth-like web 901 formed of a nonwoven fabric or the like, a feeding roller 902 for feeding the web 901, a contact roller 903 bringing the web 901 into contact with an outer peripheral surface of the second belt 25, and a winding-up roller 904 for winding up the web 901. Each of the feeding roller 902 and the winding-up roller 904 is disposed so that the web 901 as a slidable member (web member) is moved in an opposite direction to the rotational direction (arrow D direction in the figure) of the second belt 25. The winding-up roller 904 moves the web 901 so that a position where the web 901 is contacted to the second belt 25 is changed. That is, around the feeding roller 902, an unused portion of the web 901 is wound, and around the winding-up roller 904, a used portion of the web 901 is wound. As regards the web 901, the unused portion thereof is fed from the feeding roller 902 depending on that the used portion thereof is wound up by the rotation of the winding-up roller 904 as a moving unit. Then, the unused portion of the web 901 fed from the feeding roller 902 is contacted to the second belt 25 by the contact roller 903. The second belt 25 is rubbed by the web 901, whereby the deposited matter on the second belt 25 is removed.

The winding-up roller 904 is driven by a driving motor 500 for driving at least any one of the second belt stretching rollers 26*a* to 26*e*. That is, the winding-up roller 904 and at least either one of the first belt 21 and the second belt 25 are driven by the driving motor 500 which is the same driving source. However, in this case, as shown in FIG. 5, a drive transmission member such as a clutch 501 for switching transmission or non-transmission of drive to the winding-up roller 904 is provided. The switching of the transmission and the non-transmission of the drive by the clutch 501 or the like is controlled by the controller 300 (see FIG. 1). The controller 300 temporarily switches the drive transmission (state) by the clutch 501 or the like from the non-transmission (state) to the transmission (state), and causes the unused portion of the web 901 to contact the second belt 25.

Incidentally, in the case of using the belt cleaning device 90A of the web type, a heater 510 is provided in the contact roller 903 and a temperature of the deposited matter on the second belt 25 is made high, so that the deposited matter may be removed by the web 901. Further, the winding-up roller 904 may be driven by the above-described driving motor 500. However, in this case, by using a member for adjusting the number of rotations, the web 901 is fed (wound) in a predetermined amount per predetermined time.

Second Embodiment

Figure 6:
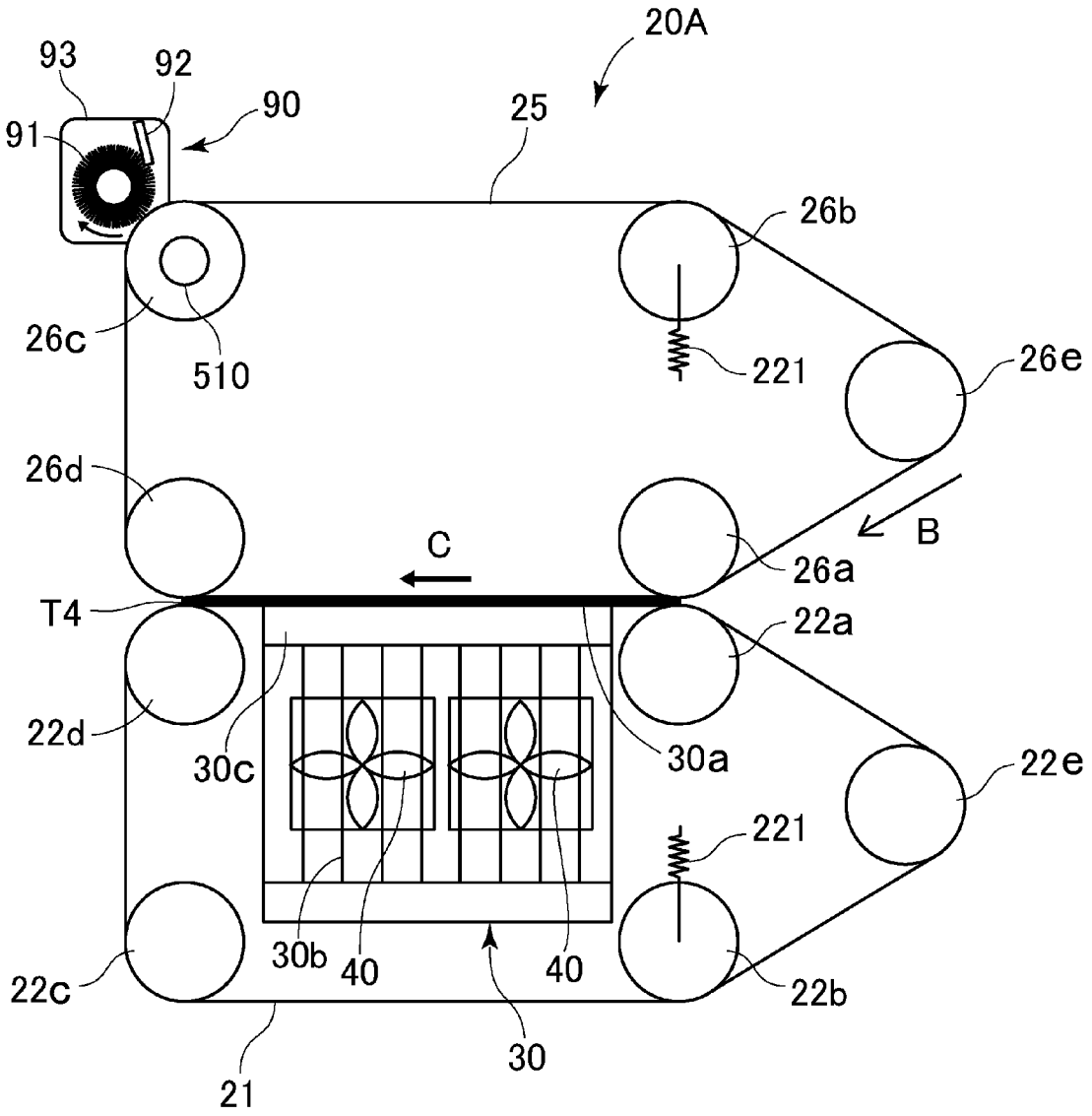
FIG. 6 is a schematic view showing a recording material cooling device of a second embodiment.
Figure 7:
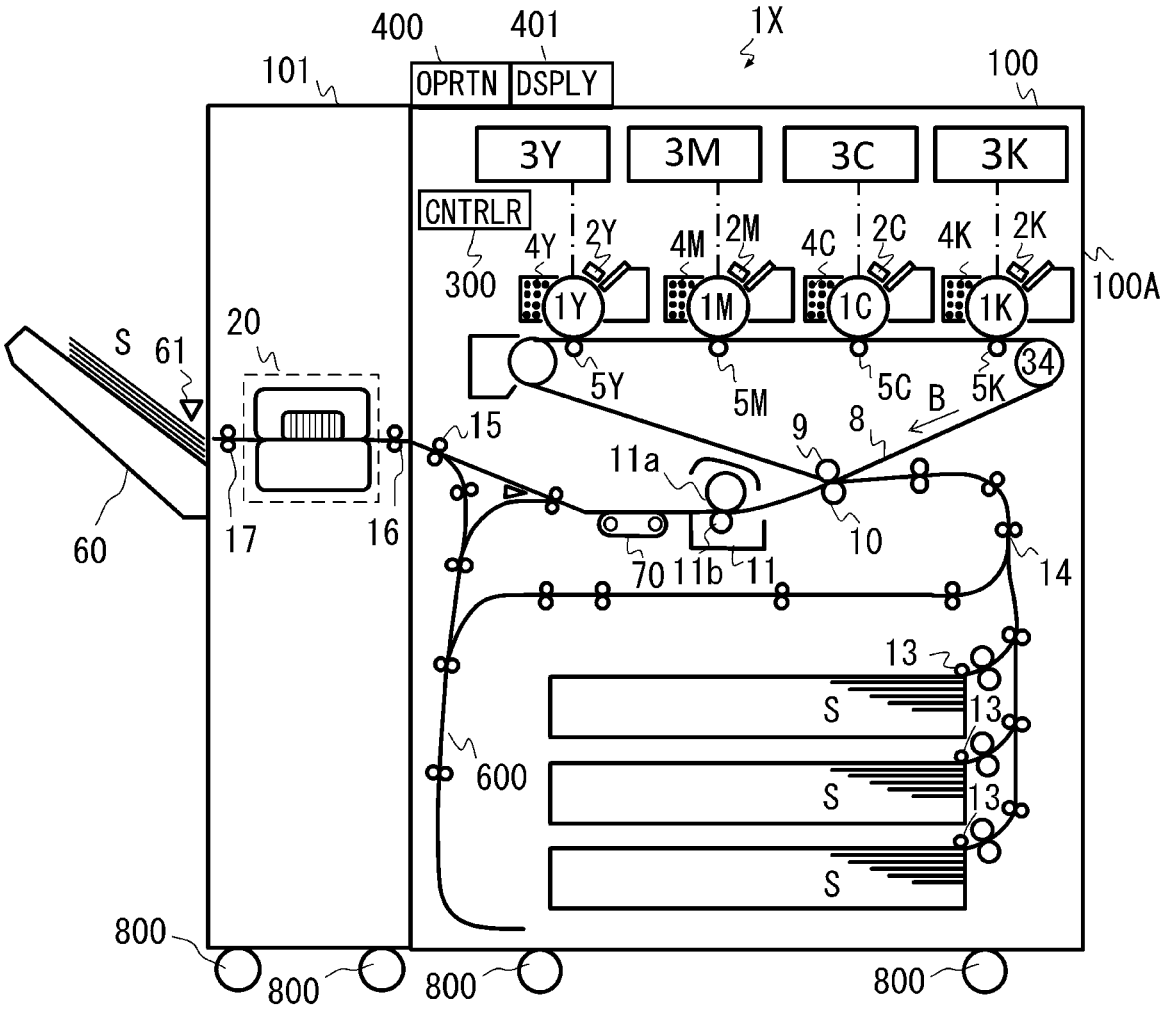
FIG. 7 is a schematic view showing an example of an image forming system.
Figure 8:
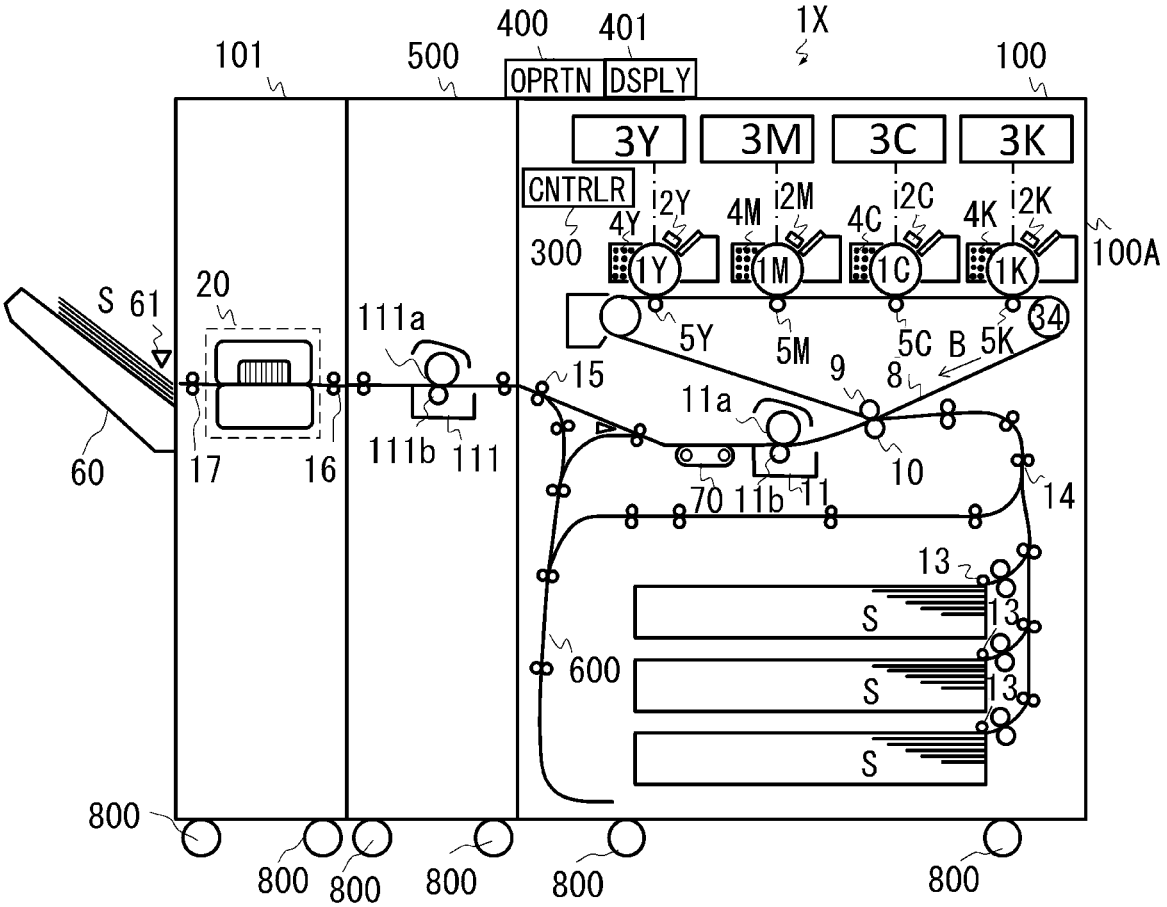
FIG. 8 is a schematic view showing an example of another image forming system.

Next, a recording material cooling device 20A of a second embodiment will be described. In the above-described recording material cooling device 20 of the first embodiment (see FIG. 3), one in which the recording material S is cooled on the surface side (side where the fixing roller 11*a* is provided) where the toner image is formed by the fixing device 11 was shown, but the present invention is not limited thereto. For example, the recording material S may also be cooled from a surface side opposite from the surface on which the toner image is formed by the fixing device 11. In FIG. 6, the recording material cooling device 20A for cooling the recording material S on the surface side (side where the pressing roller 11*b* is provided) opposite from the surface on which the toner image is formed by the fixing device 11. Incidentally, in the recording material cooling device 20A shown in FIG. 6, constituent elements which are the same as those of the recording material cooling device 20 of the first embodiment will be briefly described or omitted from description by adding the same reference numerals or symbols.

In this embodiment, the heat sink 30 contacts the first belt 21 contacting the recording material S from the surface side opposite from the surface on which the toner image is formed by the fixing device 11. In this case, when the recording material S such as the thick paper low in thermal conductivity passes through the cooling nip T4, there is a liability that cooling is not sufficiently carried out on the surface side where the recording material S contacted the second belt 25 and the deposited matter is deposited on the second belt 25.

Therefore, as shown in FIG. 6, in the recording material cooling device 20 of this embodiment, the belt cleaning device 90 is provided on the second belt 25 side. The belt cleaning device 90 may also be provided so as to slide on the second belt 25 at any position. However, the above-described belt cleaning device 90 may preferably be provided so as to slide on the second belt 25 at any position from a downstream end of the cooling nip T4 to half of a peripheral length of the second belt 25 with respect to the rotational direction (arrow B direction in the figure) of the second belt 25. Further, the belt cleaning device 90 may preferably be provided so as to slide on the second belt 25 at a position where the belt cleaning device 90 sandwiches the second belt 25 between itself and a predetermined roller of the second belt stretching rollers 26*a* to 26*e*. Herein, as an example, the belt cleaning device 90 is disposed opposed to the second belt stretching roller 26*c* while sandwiching the second belt 25 therebetween. Further, inside the second belt stretching roller 26 sandwiching the second belt 25 between itself and the predetermined roller, the heater 510 may be provided.

Thus, even in the case where by the first belt 21 cooled by the heat sink 30, the recording material S is cooled from the surface side opposite from the surface on which the toner image is formed by the fixing device 11.

Incidentally, in the above-described embodiments, the constitution in which only the second belt 25 is provided with the belt cleaning device 90 was employed, but in the case where recording materials S passed through the fixing device 11 continuously pass through the recording material cooling device 20, there is a liability that a cooling performance of the first belt 21 is also lowered, so that the deposited matter such as the toner and the wax is deposited on the first belt in some cases. In this case, the first belt 21 is also provided with a belt cleaning member 90 for cooling an outer peripheral surface of the belt, so that the deposited matter deposited on the first belt 21 can also be removed. Thus, a constitution in which both the first belt 21 and the second belt 25 are provided with the belt cleaning member 90 may also be employed. Further, a constitution in which the heat sink 30 contacting the inner peripheral surface of the first belt 21 and another heat sink contacting the inner peripheral surface of the second belt 25 are provided and in which a plurality of cooling units are provided so as to clean the first belt 21 and the second belt 25, respectively, may also be employed.

Incidentally, in the above-described embodiments, the constitution in which the fixing device 11 and the cooling device 20 are provided in the single casing (apparatus main assembly 100A) of the image forming apparatus 100 was employed, but a constitution in which the above-described cooling device 20 is provided in an image forming apparatus such that the image forming portions PY, PM, PC and PK, the intermediary transfer belt 8 and the secondary transfer roller 10 are provided in a first casing and the fixing device 11 and the cooling device 20 are provided in a second casing different from the first casing and that a single apparatus is constituted by the first casing and the second casing may also be employed.

Further, when the constitution including the cooling device provided on a side downstream of the fixing device 11 with respect to a recording material feeding direction is employed, such a constitution may also be not limited to the above constitution. For example, as shown in FIG. 9, a constitution in which the cooling device 20 is provided in an external cooling apparatus 101 connected to the image forming apparatus 100 may also be employed. Incidentally, as regards an image forming system 1X shown in FIG. 9, each of the image forming apparatus 100 and the external cooling apparatus 101 is installed on an installation surface such as a floor by a plurality of installation portions 800. Here, the installation portions 800 are casters, installation legs, and the like.

Further, when the cooling device provided on a side downstream of the fixing device in the image forming system is used, a constitution in which as in an image forming system shown in FIG. 9, the cooling device 20 is provided in an external cooling apparatus 101 which is connected to the image forming apparatus 100, to which an external fixing apparatus 500 is connected on a side downstream of the image forming apparatus 100 with respect to the recording material feeding direction, on a side further downstream of the external fixing apparatus 500 may also be employed.

INDUSTRIAL APPLICABILITY

According to the present invention, a cooling device, an image forming apparatus and an image forming system which are capable of removing a deposited matter deposited on the second belt which forms the nip between itself and the first belt and which nips and feeds the recording material, in a constitution in which the recording material after toner image fixation is cooled by a belt cooling type.

The present invention is not limited to the above-described embodiments, but can be variously changed and modified without departing from the spirit and the scope of the present invention. Accordingly, the following claims are attached for making the scope of the present invention public.

The invention claimed is:

1. An image forming system comprising:

an image forming portion configured to form a toner image on a recording material;

a fixing device including a heating portion and a pressing portion to press against said heating portion so as to form a fixing nip for fixing the toner image to the recording material in cooperation with said heating portion; and a cooling device provided downstream of said fixing device with respect to a feeding direction of the recording material and configured to cool the recording material passed through said fixing device, wherein said cooling device comprises:

a first belt;

a second belt configured to form a nip portion nipping and feeding the recording material in cooperation with said first belt;

a heat sink in contact with an inner peripheral surface of said first belt at a position corresponding to said nip portion; and a cleaning unit, in contact with an outer peripheral surface of said second belt, configured to remove a deposited matter deposited on the outer peripheral surface of said second belt.

2. The image forming system according to claim 1, wherein said cleaning unit contacts the outer peripheral surface of said second belt at a position between a downstream end of the nip portion and half of a peripheral length of said second belt with respect to a rotational direction of said second belt.

3. The image forming system according to claim 1, further comprising a plurality of stretching rollers, in contact with the inner peripheral surface of said second belt, configured to stretch said second belt, wherein said cleaning unit includes a slidable member configured to slide on the outer peripheral surface of said second belt, and wherein said slidable member slides on said second belt at a position opposing a predetermined roller of said plurality of stretching rollers.

4. The image forming system according to claim 3, wherein said plurality of stretching rollers include a driving roller driven by a motor, and said predetermined roller is positioned downstream of said driving roller with respect to a rotational direction of said second belt.

5. The image forming system according to claim 3, further comprising a heating unit configured to heat said predetermined roller.

6. The image forming system according to claim 3, wherein said slidable member is a rotatable slidable member configured to slide on said second belt by being rotated.

7. The image forming system according to claim 6, wherein said rotatable slidable member and said second belt are driven by the same driving source.

8. The image forming system according to claim 3, wherein said slidable member is a cloth-like web member configured to slide on said second belt, and wherein said cleaning unit includes (i) said web member, (ii) a contact roller configured to bring said web member to contact said second belt, and (iii) a moving unit for moving said web member so as to change a position where said web member contacts said second belt.

9. The image forming system according to claim 8, further comprising a heating unit configured to heat said contact roller.

10. The image forming system according to claim 1, wherein said first belt is provided on a side of said feeding passage on which said heating portion is provided.

11. The image forming system according to claim 1, further comprising a reverse feeding portion configured to reverse a first side and a second side of the recording material on which the toner image is fixed by said fixing device and further configured to feed the recording material again to said image forming portion.

12. The image forming system according to claim 1, wherein said cooling device further includes another cleaning unit, in contact with the outer peripheral surface of said first belt, configured to remove a deposited matter deposited on the outer peripheral surface of said first belt.

* * * * *